United States Patent [19]

Bley

[11] Patent Number: 4,534,602

[45] Date of Patent: Aug. 13, 1985

[54] R.F. MULTI-PIN CONNECTOR

[75] Inventor: David W. Bley, Mountain View, Calif.

[73] Assignee: Fairchild Camera & Instrument Corp., Mountain View, Calif.

[21] Appl. No.: 382,280

[22] Filed: May 26, 1982

[51] Int. Cl.[3] ..... H01R 23/68

[52] U.S. Cl. ..... 339/14 R; 339/17 A; 339/59 M; 339/DIG. 3

[58] Field of Search ..... 339/DIG. 3, 59 R, 59 M, 339/61 R, 61 M, 143 R, 14 R, 177 R, 177 E, 17 A, 92 M

[56] References Cited

U.S. PATENT DOCUMENTS

| | | | |
|---|---|---|---|
| 2,304,210 | 12/1942 | Scott et al. | 339/DIG. 3 |
| 2,379,942 | 7/1945 | Webber | 339/DIG. 3 |
| 2,879,491 | 3/1959 | Shapiro | 339/92 M X |
| 3,160,456 | 12/1964 | O'Keefe et al. | 339/92 M |
| 3,201,743 | 8/1965 | Huber et al. | 339/92 M |

OTHER PUBLICATIONS

Chomerics, "Sexless Cho-Connectors", Dec. 2, 1974.

AMP Catalog Number 74-288, revised 2-79, 16, "Multiple COAXICON Connectors".

CHOMERICS, CHO-SEAL, CHO-SIL, CHO--FOAM, "Standard EMI/RFI Conductive Elastomer Gaskets".

*Primary Examiner*—Z. R. Bilinsky

*Attorney, Agent, or Firm*—Carl Silverman; Steven F. Caserza; Alan H. MacPherson

[57] ABSTRACT

A novel zero insertion (and removal) force multi-pin coaxial connector for providing connecting via controlled impedance paths is formed using a conductive elastomer as a frame (8) which forms the shield of a plurality of coaxial connectors and a plurality of circular openings formed in the conductive elastomer frame, each said opening corresponding to a single coaxial connection. An annular insulating ring (5), which forms the dielectric of an associated one of the coaxial connectors, is located in each annular opening of the conductive elastomer frame and an elastomer through-conductive member (6) which forms the center conductor of its associated coaxial connector is located within the circular opening of each insulating ring. In this manner, the conductive elastomer frame forms the shield of a plurality of coaxial connectors. A connector board for use with a plurality of coaxial cables is designed such that it will properly mate with the conductive elastomer frame and conductive elastomer through-conductive members, thus connecting the plurality of coaxial cables to one side of their associated coaxial connectors within the conductive elastomer frame. The connector board contains a plurality of conductive paths which are formed so as to properly abut the conductive elastomer frame and the elastomer through-conductive members of the coaxial connector. In this manner, each coaxial cable is connected through the zero insertion force multi-pin connector to their associated conductive paths on the printed circuit board. Alternatively, the multi-pin connector is used to connect two printed circuit boards.

12 Claims, 5 Drawing Figures

FIG. 1b
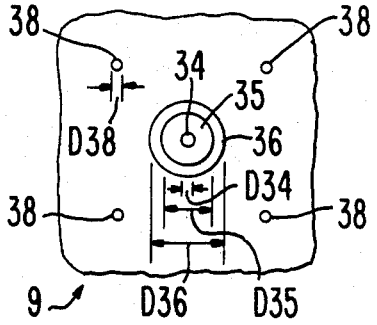
FIG. 1c
FIG. 1a
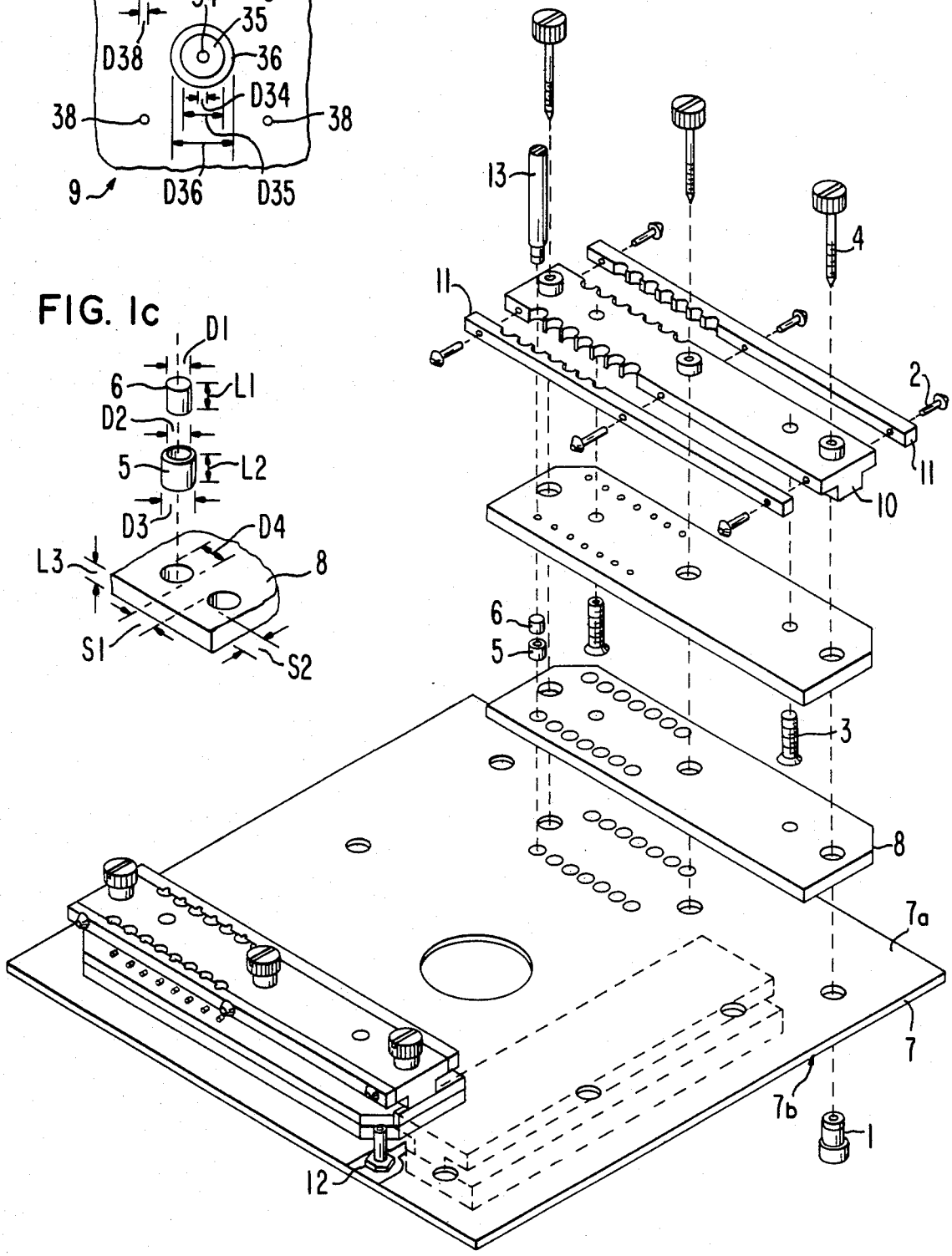

R.F. MULTI-PIN CONNECTOR

BACKGROUND OF THE INVENTION

1. Field of the Invention

This invention relates to electrical connectors suitable for use with high frequency and radio frequency signals.

2. Description of the Prior Art

A wide variety of connectors are known in the prior art. In many applications, a single structure, such as a plug housing, must contain a large number of connecting means in order to allow many signal paths to be connected through a single plug. With an increasing number of connectors contained on a single plug device, the insertion and removal force required when connecting and disconnecting the plugs increases, often times to an unacceptable level. To circumvent this problem, the so-called "zero insertion force" connectors are used in certain applications. For example, Fairchild Camera & Instrument Corporation, the assignee of this invention, manufactures and sells "pinless contact rings" under their part numbers 95-8349-01 (24 pins) and 95-8349-00 (60 pins) for use with their Sentry® series of test systems. Such pinless contact rings typically comprise a ring of insulating material such as a suitable plastic material into which a plurality of holes have been formed. Into each of these holes is placed a malleable conductive material which is held securely in its associated hole within the pinless contact ring, and which extends on either side of the pinless contact ring in order to allow electrical connection to each side. Thus, the pinless contact rings may be placed on a first printed circuit board with each of the conductive segments contacting a desired electrical connection on the first printed circuit board. Thereafter, a second printed circuit board is placed on top of the pinless contact ring, with the conductive members of the pinless contact ring making electrical contact with various portions of the second printed circuit board. In this manner, electrical connection is established between the first and second printed circuit boards, without requiring any insertion or removal force associated with other prior art plug means.

However, such pinless contact rings are not suitable for use with high frequency and radio frequency signals because the characteristic impedance of the through conductors placed in the pinless contact ring is not controlled. Furthermore, because the pinless contact ring is necessarily made of a non-conductive material, shielding between adjacent conductive members is virtually non-existent, with cross-talk between conductive members the result.

Another attempt to make a zero insertion force connector for providing connection to an integrated circuit device is described in U.S. Pat. No. 4,150,420 issued Apr. 17, 1979 to Berg. The Berg structure provides a plurality of electrical connectors by the use of an equal plurality of metal "fingers", which are biased by a resiliant material such as silicone rubber. However, the Berg structure does not provide coaxial connectors.

In order to provide adequate shielding and a controlled characteristic impedance, coaxial cable is used. In order to maintain this shileding and characteristic impedance at the connection point, coaxial connectors are used. Such coaxial connectors, including the standard "BNC" type connectors, are well known in the prior art. However, when a large number of coaxial connections must be made, a correspondingly large number of coaxial connectors must be used. This results in rather high cost, and a large amount of effort to connect and disconnect the large number of coaxial connectors, as well as to maintain the proper connections among coaxial cables.

One solution to this problem of providing a number of coaxial connections is to form a number of coaxial connectors in a single connector block. Multiple coaxial connectors within a single block are described, for example, in the MULTIPLE COAXICON CONNECTORS catalog number 74-286 available from AMP Incorporated, Harrisburg, Pa. However, such multiple coaxial connectors require a large insertion force and a large removal force, as well as being rather expensive, bulky, and awkward to handle.

Furthermore, in many applications, the shear bulk of such prior art coaxial connectors is prohibitive. For example, in electronic component testing and more particularly advanced semiconductor device testing, a large number of connections must be made to a semiconductor device in order to test the device. Furthermore, in semiconductor testing, such connections must be made at the wafer level prior to packaging, for example, in the dual in line packages (DIPs) or the newer "leadless" packages (also called "chip carriers"). Because of the limited space available on the circuit boards which must be placed on the test systems in order to test either wafers or packaged devices, as well as the sometimes frequent changing of test boards required in the semiconductor industry, such prior art coaxial connectors are at best undesirable, and at worst impossible to use given the limited amount of space available.

SUMMARY

In accordance with one embodiment of this invention, a novel multi-pin coaxial connector is formed using a conductive elastomer as a so-called frame. A plurality of circular openings are formed in the conductive elastomer frame, each said opening corresponding to a single coaxial connection. An annular insulating ring, or spacer, is then placed in each circular opening of the conductive elastomer frame. An elastomer through-conductive member is then placed within the circular opening of each spacer. In this manner, the conductive elastomer frame forms the shield of a plurality of coaxial connectors, each spacer forms the dielectric of an associated one of the coaxial connectors, and each elastomer through-conductive member forms the center conductor of its associated coaxial connector.

In this embodiment of my invention a conductive elastomer is used as both the frame and the through-conductive members of each coaxial connector, and such elastomers are somewhat flexible and compressible, the plurality of coaxial connectors constructed in accordance with this invention require no insertion or removal force because electrical contact is made by causing conductive regions to abut the frame and the through-conductive members.

In accordance with another embodiment of this invention, a connector board is also used wherein a plurality of coaxial cables are connected to the connector board. The connector boards is designed such that it will properly mate with the conductive elastomer frame and conductive elastomer through-conductive members, thus connecting the plurality of coaxial cables to one side of their associated coaxial connectors within the conductive elastomer frame. Similarly the circuit board to which connection is to be made contains a plurality of conductive paths which are formed so as to properly mate with the conductive elastomer frame and the elastomer through-conductive members of the coaxial connector. In this manner, each coaxial cable is connected through the zero insertion force multi-pin connector of this invention to its associated conductive path on the printed circuit board.

In another embodiment of this invention, the multi-pin connector of this invention is used to connect two printed circuit boards rather than one printed circuit board and a plurality of coaxial cables.

In order to provide the required mechanical support between the multi-pin connector of this invention and the members which it connects, mechanical coupling means, such as simple screws or clamps, are utilized with no deleterious effect on the operation of the multi-pin coaxial connector of this invention.

BRIEF DESCRIPTION OF THE DRAWING

FIG. 1*a* shows an exploded view of one embodiment of the multi-in coaxial connector constructed in accordance with this invention used to connect a plurality of coaxial cables with a plurality of conductive paths on a printed circuit board;

FIG. 1*b* shows an expanded view of a portion of the surface of connector board 9 of FIG. 1*a;*

FIG. 1*c* shows an expanded view of a portion of the multi-pin coaxial connector of FIG. 1*a,* including dimensions referred to in the Detailed Description portion of this specification.

DETAILED DESCRIPTION

Figure 2A:
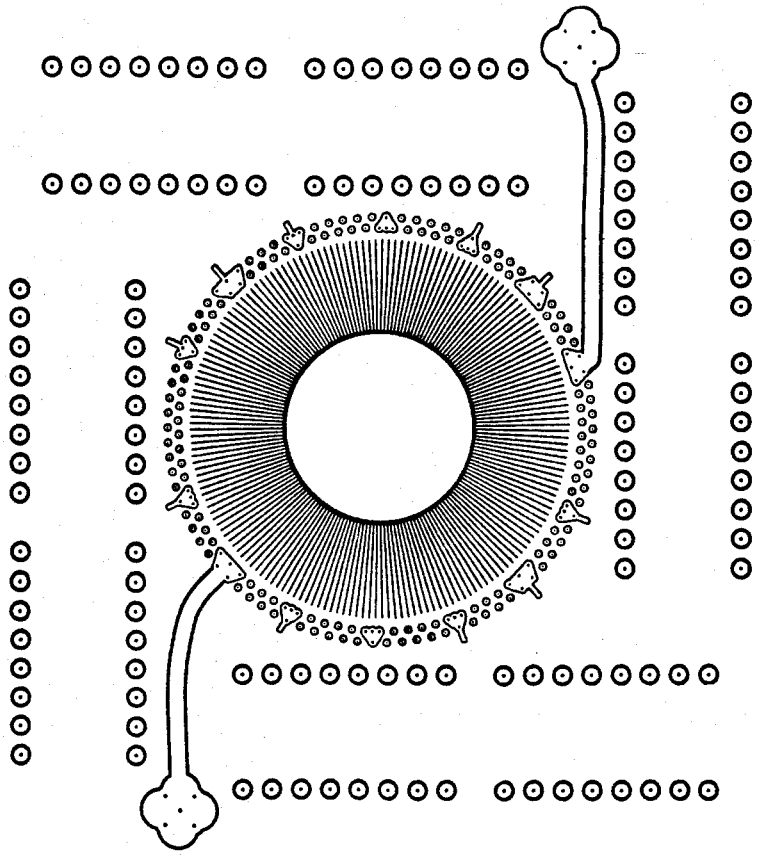
FIGS. 2*a* and 2*b* show the conductive patterns of top surface 7*a* and bottom surface 7*b,* respectively, of circuit board 7 of FIG. 1*a.*

FIG. 1*a* shows an exploded view of one embodiment of the multi-pin coaxial connector of this invention when used to connect a plurality of coaxial cables 13 to a printed circuit board 7. The multi-pin coaxial connector of this invention comprises a conductive elastomer frame 8 formed in any desired pattern conductive to placement between printed circuit boards 7 and 9 for providing conductive paths of controlled impedance therebetween. One such conductive elastomer which is used to form frame 8 is Cho-seal TM material number 1215 available from Chomerics Materials, Inc. of Woburn, Mass. The Cho-seal material 1215 is available as a rolled sheet, which is cut or punched into the desired shape for frame 8. The Cho-seal material 1215 is described in the CONDUCTIVE ELASTOMER GASKET catalog available from Chomerics Materials, Inc. Cho-seal material 1215 provides a frame 8 of very low resistivity and adequate compressibility for the purpose of providing zero insertion force multi-pin coaxial connectors. The DC volumetric resistivity of Cho-seal material 1215 is approximately 0.004 ohm-cm and the deflection (compressibility) of a 0.032" thick sample is approximately 7.2% at 100 psi.

A plurality of openings, preferrably circular but capable of being formed in any other desired shape, are formed within frame 8 in order to provide an equal plurality of coaxial connectors. Naturally, these openings need not be circular. Spacers 5 are placed within the openings of frame 8 and serve as the dielectric material of each coaxial connector. In one embodiment of this invention, spacers 5 (typically tube-shaped or cylindrical with a circular opening in the middle) are formed of Delron TM material, Teflon TM material, or any other easily machinable plastic. Delron, for example, has a dielectric constant of approximately 4 and Teflon has a dielectric constant of approximately 2.1, and both Delron and Teflon are well suited for use as the dielectric material of the multi-pin coaxial connector of this invention. Preferably, this dielectric material is machined from a stock of tubular material, such as Delron or Teflon, both available from Dupont.

Through-conductive members 6 are then placed within each spacer 5. Each through conductive member 6 form the inner conductor of one of the plurality of coaxial connectors formed within frame 8. In one embodiment, through-conductive members 6 are formed of Cho-seal material 1250 also available from Chomerics Materials, Inc. and described in their aforementioned CONDUCTIVE ELASTOMER GASKET catalog. Cho-seal 1250 has a DC volumetric resistivity of approximately 0.004 ohm-cm and compressibility approximately equal to the compressibility of the Cho-seal 1215 material used for frame 8. The Cho-seal 1250 material is available as extruded strands which are then cut to the appropriate size.

Figure 2B:
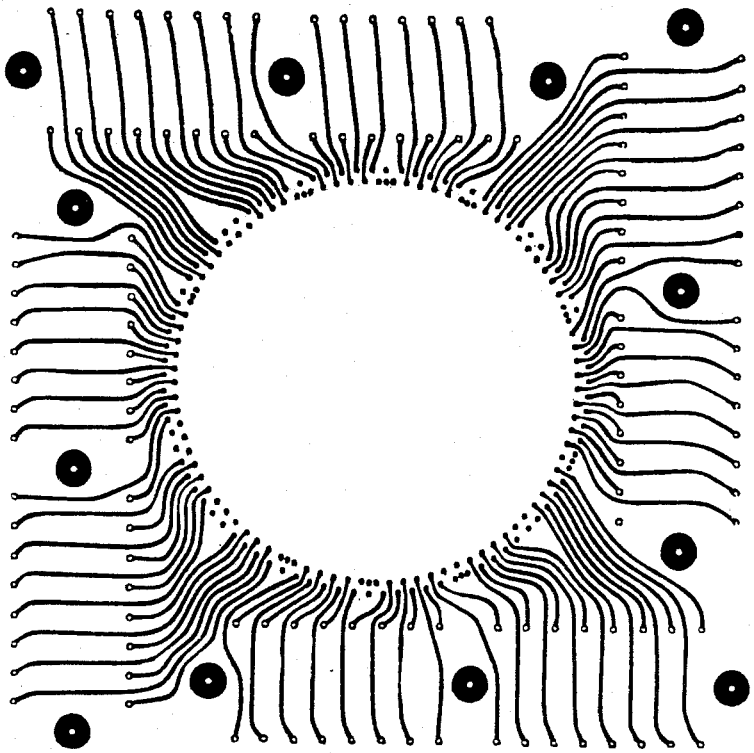

As shown in FIG. 1*a,* the coaxial connectors formed within frame 8 are used to provide a plurality of connections between circuit board 7 and connector board 9. The top surface 7*a* of one embodiment of circuit board 7 well suited for use in testing semiconductor wafers is shown in FIG. 2*a,* and the bottom surface 7*b* of circuit board 7 is shown in FIG. 2*b.* Thus, it is seen in FIG. 2*a* that the surface 7*a* is designed to accommodate four separate multi-pin coaxial connectors constructed in accordance with this invention, each of said multi-pin coaxial connectors providing a controlled impedance connection to 32 separate conductive paths on circuit board 7. Thus, circuit board 7 receives a total of 128 coaxial connections in a very small space. Furthermore, the spacing between coaxial connectors can, if desired, be substantially reduced, thereby further increasing the density of coaxial connectors applied to circuit board 7.

Referring again to FIG. 1*a,* it is seen that the coaxial connector formed by conductive frame 8 and dielectric spacers 5 provides a plurality of coaxial connections between circuit board 7 and connector board 9. In alternative embodiments of this invention, connector board 9 is replaced by another printed circuit board containing a plurality of components. However, as shown in FIG. 1*a,* connector board 9 is used to provide a terminus for a plurality of coaxial cables 13. Thus, the signal path is formed from coaxial cable 13 to connector board 9 to the multi-pin coaxial connector formed within frame 8 to the desired location on circuit board 7. Connector bracket clamp 11, in conjunction with connector bracket 10, structurally support the coaxial cables 13 which are connected to connector board 9. When circuit board 7 is used to hold a plurality of probes for testing semiconductor die, connector bracket clamp 11, connector bracket 10, connector board 9 and frame 8 provide additional rigidity to circuit board 7, thus eliminating undesirable flexing of circuit board 7. In one embodiment of this invention, connector bracket clamp 11 and connector bracket 10 are formed of aluminum due to its durability and ease of machining. Connector bracket clamp 11 is mounted to connector bracket 10 via screw 2. Connector bracket 10 is mounted to connector board 9 via screws 3. Connector board 9 comprises, for example, a typical printed circuit board, with holes provided for the center conductor of each coaxial cable 13 to make electrical connection by abutting with its associated through-conductive member 6. Connector bracket 10, connector board 9 and the plurality of coaxial connectors formed within frame 8 are held fixed to circuit board 7 by screws 4 and nuts 1. In one embodiment of this invention, nuts 1 are press-fit into circuit board 7 and screws 4 are captive screws which are held captive by connector bracket 10.

An expanded view of a portion of the surface of connector board 9 is shown in FIG. 1*b*. The portion of connector board 9 shown in FIG. 1*b* corresponds to a single coaxial connection; connector board 9 thus contains on its surfaces a plurality of the patterns shown in FIG. 1*b* equal to the plurality of coaxial connections which are to be made to connector board 9. Connector board 9 contains on most of its surface a conductive ground plane region 37. Connector board 9 also includes a plated through-hole 34 through which the center conductor of a coaxial cable (not shown) is placed and soldered. Region 35 surrounding plated through-hole 34 is a conductive region connected to plated through-hole 34, which abuts through conductive member 6 (FIG. 1*a*) when connection is made through the coaxial connector by this invention. Surrounding conductive region 35 is an annular ring of insulating material 36 (typically formed by removal of copper plating on the printed circuit board) thus providing electrical insulation between conductive region 35 and ground plane 37. As previously described, the center conductor is placed within plated through-hole 34 and soldered thereto. The shield of the coaxial cable (not shown) is soldered at several points to ground plane 37 around annular ring 36. A plurality of plated through-holes 38 are formed within ground plane region 37 surrounding annular ring 36, thus provided electrical connection from ground plane 37 formed on one side of connector board 9 to the ground plane formed on the opposite side of connector board 9. The opposite side of connector board 9 is identical with the side of connector board 9 shown in FIG. 1*b*, with the exception that the diameter of conductive region 35 is different, as will be more fully described below. The diameter of plated through-hole 34 is labelled in FIG. 1*b* as D34; the diameter of conductive region 35 is labelled as D35; the diameter of insulating annular ring 36 is labelled as D36; and the diameter of plate through-hole 38 is labelled as D38.

In one embodiment of this invention, where RG188 cable is used, the diameter D34 of plated through-hole 34 is equal to approximately 0.020 inches, which is just slightly larger than the outside diameter of the center conductor of the RG188 cable. On the surface of board 9 which faces the RG188 coaxial cable, the diameter D35 of conductive region 35 is approximately 0.060 inches, and the diameter of annular ring 36 is approximately 0.140 inches, thus providing a 0.040 inch gap between the outside edge of conductive region 35 and ground plane 37. This provides sufficient space to prevent solder bridging between conductive area 35 and ground plane 37 when the shield of the coaxial cable is soldered to ground plane 37 at various locations around annular ring 36. The diameter of plated through-holes 38 is approximately 0.025 inches. Similarly, on the opposite side of connector board 9 which is to come in contact with frame 8 (FIG. 1*a*) and the through conductors 6 located therein, the dimensions D34 through D38 are the same as previously mentioned with the exception that the diameter of D35 conductive region 35 is approximately 0.100 inches, which as will be described momentarily, matches the diameter of one embodiment of through conductor 6 which comes in contact with conductive region 35. While the use of a conductive region 35 of approximately 0.100 inches diameter reduces the spacing between the outside edge of region 35 and ground plane 37 to approximately 0.02 inches, this is sufficient separation on that side of the board 9 which contacts frame 8 because the coaxial cable is not soldered to ground plane 37 around annular ring 36 on that side of connector board 9.

An expanded view of a portion of frame 8, dielectric 5 and through conductor 6 is shown in FIG. 1*c*, together with certain indicated dimensions. In one embodiment of this invention, this thickness L3 of frame 8 is approximately 0.125 inches, the length L2 of dielectric 5 is approximately 0.115 inches, and the length L1 of through conductor 6 is approximately 0.125 inches. In this embodiment, the length of dielectric 5 is approximately seven percent less than the thickness of frame 8 and the length of through-conductor 6, thus allowing compression of frame 8 and through-conductor 6 which, as previously described, have compressibilities on the order of seven percent. In one embodiment of this invention, the outside diameter D1 of through-conductor 6 is equal to the inside diameter D2 of dielectric 5 and the outside diameter D3 of the dielectric 5 is equal to the inside diameter D4 of the annular opening within frame 8. In this manner, dielectric 5 is press fit into frame 8 and through conductor 6 is press fit into dielectric 5.

When Cho-seal material 1250 is used as frame 8 (FIG. 1*a*), the manufacturer recommends that small holes (i.e. less than approximately 0.100 inches) be formed no closer than one hole diameter to the edge of frame 8 or to adjacent holes. Thus, the distance S1 between holes and the distance S2 from the edge of frame 8 to the edge of a hole is preferably not less than the diameter D4 of the hole, although this restriction is not absolutely required.

The formula for the characteristic impedance of a coaxial conductor is well known and given as follows:

$$Z_0 = 138(e_r)^{\frac{1}{2}} \log_{10}(D3/D1) \quad (1)$$

where $Z_0$ = the characteristic impedance of the coaxial conductor;

$e_r$ = the relative dielectric constant of the insulating material separating the inner and outer conductors;

D3 = D4 = the outside diameter of the insulating material and the inside diameter of the outer conductor; and D1 = D2 = the inside diameter of the insulating material and the outside diameter of the inner conductor.

The characteristic impedance most commonly used for high frequency pulse work is 50 ohms. To illustrate the number of coaxial connectors which may be formed in a given size (i.e. the density) in accordance with this invention, assume that a center conductor 6 having diameter 0.030", and an insulator 5 of Teflon material is used. Thus, utilizing equation (1), $Z_0$ equals 50 ohms, $e_r$ equals 2.1, D1 equals 0.030" and thus D3 equals 0.100". Following the manufacturer's recommended edge distance S2, the effective packing density of 50 ohm coaxial connectors constructed with these dimensions is 25 coaxial connectors per square inch, including 0.100"

between the edge of each hole and the edge of the frame 8.

Similarly, utilizing a Teflon insulator, a through conductor having diameter D1 equal to 0.030", coaxial connectors are formed utilizing the teachings of this invention having a characteristic impedance of 95 ohms when the diameter D3 equals D4 equal 0.300". Thus, a coaxial connector of characteristic impedance 95 ohms (the highest impedance typically used in high frequency pulse work) is formed to only 0.5" across (allowing 0.100" material on each side to serve as the outer conductor).

Similarly, a 17 ohm coaxial connector is formed utilizing a somewhat larger through conductor 6 (of diameter D1 equal to 0.093") and a Teflon insulator 5 having outside diameter D3 equal to 0.140", thus providing a coaxial connector of characteristic impedance 17 ohms. It is well known that if a discontinuity is of a small size relative to the signal wavelength (i.e. less than approximately 25 percent of the electrical length of a pulse edge), the discontinuity can be treated as a "lumped reactance" and the signal reflections due to the discontinuity can be ignored. Thus, because of the very small length of the coaxial connectors which are constructed in accordance with this invention relative to the typical signal wavelengths, the characteristic impedance of the coaxial connector need not be precisely matched to the characterisic impedance of the conductors on either side of the coaxial connector. For example, a coaxial connector constructed in accordance with this invention having characteristic impedance of 17 ohms is quite suitable for use in a 50 ohm system up to a rather high frequency.

The effective capacitance per unit length of a coaxial conductor is given in the following equation:

$$C=1/(VZ_0) \quad (2)$$

where

C=the effective capacitance per unit length of the coaxial conductor;

V=the electrical velocity of the signal through the conductor in cm/sec; and $Z_0$=the characteristic impedance of the coaxial conductor.

Thus, when RG 188 cable is used as the 50 ohm coaxial conductor on each side of a 17 ohm coaxial connector constructed in accordance with this invention, the capacitance per unit length for the RG 188 cable, having an electrical velocity of approximately $2.07\times10^{10}$ cm/sec, is approximately 0.9 picofarad/cm. Similarly, the effective capacitance per unit length of the coaxial connector, which also has an electrical velocity of approximately $2.07\times10^{10}$ cm/sec is approximately 2.8 picofarad/cm. Thus utilizing this 17 ohm coaxial connector results in an excess capacitance (i.e. the "lumped reactance") of approximately 1.9 picofarad/cm of connector length. In this case, the coaxial connector length is approximately 0.125" or approximately 0.32 cm. Therefore, the excess capacitance provided by the 17 ohm coaxial connector is approximately 0.6 picofarads, thus providing a time constant $T=(Z_0C)=30$ picoseconds.

As defined in equation 2-33 of the test by Millman and Taub entitled "Pulse, Digital, and Switching Waveforms", McGraw-Hill Book Company, 1965, the passband of the circuit is defined as:

$$f=0.35/(2.2T) \quad (3)$$

where f=the passband; and

T=the time constant provided by the excess capacitance.

With a time constant of approximately 30 picoseconds, the pass band provided by this system utilizing RG 188 cable and a 17 ohm coaxial connector constructed in accordance with this invention is approximately 5.3 gigahertz.

Thus, because of the rather short length of the coaxial connectors which are formed in accordance with this invention, the characteristic impedance of the coaxial connector need not be precisely matched to the characteristic impedances provided on each side of the coaxial connector, without a deleterious effect on the pass band of the system.

In another embodiment of this invention, a plurality of coaxial connections are provided in a single structure, wherein the coaxial connections each have their own characteristic impedance. In other words, coaxial connectors of different characteristic impedances, as desired, are formed in a single structure.

While specific embodiments of my invention have been described in this specification, it is to be understood that these embodiments serve only as examples of my invention and not as limitations on the scope of my invention. Numerous other specific embodiments of my invention will become apparent to those of ordinary skill in the art in light of the teachings of this specification.

I claim:

1. A coaxial connector for electrically connecting a plurality of conductive regions via a plurality of controlled impedances comprising:

a compressible conductive frame serving as the outer conductor and having a first plurality of holes formed therethrough, said compressible conductive frame not including a solid metal conductor in close proximity to said plurality of conductive regions;

a tubular insulator located within each of said first plurality of holes; and a compressible conductive inner conductor located within each said tubular insulator, said compressible conductive inner conductor not including a solid metal conductor, thereby providing a coaxial connector requiring no insertion or removal force, whereby electrical connection is made by causing said conductive regions to abut said frame and said inner conductors.

2. A coaxial connector as in claim 1 wherein said compressible conductive frame and said compressible inner conductor comprise conductive elastomer material.

3. Structure as in claim 1 which further comprises two printed circuit boards, wherein said coaxial connector provides electrical contact between said two printed circuit boards, said printed circuit boards containing conductive patterns for electrically connecting desired portions of said printed circuit boards to said conductive frame and said inner conductor.

4. A coaxial connector as in claim 3 wherein at least one said printed circuit boards serves as a terminus of a coaxial cable.

5. A coaxial connector as in claim 4 wherein said terminus of a coaxial cable includes means for securing said coaxial cable to said terminus.

6. A coaxial connector as in claim 1 wherein said conductive frame and each said conductive inner conductor have uncompressed thicknesses when not abutted to said conductive regions and are compressed to their compressed thicknesses when abutted to said conductive regions, wherein each said tubular insulator is slightly shorter along its axis than the uncompressed thickness of said compressible conductive inner conductor and wherein each said tubular insulator is substantially equal in length along its axis to the compressed thicknesses of said compressible conductive frame and said conductive inner conductor.

7. A connector means providing a plurality N of coaxial connectors of controlled impedance between a plurality of conductive regions, where N is a positive integer greater than or equal to one, comprising:

a compressible conductive frame serving as the outer conductor of each said N coaxial connectors and having a plurality of N holes formed therethrough, said compressible conductive frame not including a solid metal conductor in close proximity to said plurality of coaxial connectors, a plurality of N tubular insulators, each said tubuar insulator located within an associated one of said holes; and a plurality of N compressible conductive inner conductors, each located within an associated one of said tubular insulators, said compressible conductive inner conductor not including a solid metal conductor, thereby providing a plurality of N coaxial connectors requiring no physical force to connect or disconnect said connector means.

8. Connector means as in claim 7 wherein said compressible conductive frame and said compressible inner conductor comprise conductive elastomer material.

9. Structure as in claim 7 which further comprises two printed circuit boards, wherein said plurality of N coaxial connectors make contact between said two printed circuit boards, said printed circuit boards containing conductive patterns for electrically connecting desired portions of said printed circuit boards to said conductive frame and said inner conductors.

10. Structure as in claim 9 wherein at least one said printed circuit board serves as a terminus of one or more coaxial cables.

11. Structure as in claim 10 wherein said terminus of coaxial cables includes means for securing said one or more coaxial cables to said terminus.

12. A coaxial connector as in claim 7 wherein said conductive frame and each said conductive inner conductor have uncompressed thicknesses when not abutted to said conductive regions and are compressed to their compressed thicknesses when abutted to said conductive regions, wherein each said tubular insulator is slightly shorter along its axis than the uncompressed thicknesses of said compressible conductive inner conductor and wherein each said tubular insulator is substantially equal in length along its axis to the compressed thicknesses of said compressible conductive frame and said conductive inner conductor.

* * * * *

UNITED STATES PATENT AND TRADEMARK OFFICE

CERTIFICATE OF CORRECTION

PATENT NO. : 4,534,602

DATED : August 13, 1985

INVENTOR(S) : David W. Bley

It is certified that error appears in the above—identified patent and that said Letters Patent is hereby corrected as shown below:

In the Abstract, line 2, change "connecting" to --connections--.

Col. 1, line 64, change "shileding" to --shielding--.

Col. 2, line 55, before "such" insert --as--.

Col. 3, line 23, change "multi-in" to --multi-pin--.

Col. 3, line 43, change "conductive" to --conducive--.

Col. 5, line 36, change "provided" to --providing--.

Col. 6, line 2, delete "as".

Col. 7, line 64, change "test" to --text--.

In the drawings, Sheet 1,Fig. 1a, the reference numeral 9 should be added referencing the connector board between frame 8 and connector bracket 10.

UNITED STATES PATENT AND TRADEMARK OFFICE

CERTIFICATE OF CORRECTION

PATENT NO. : 4,534,602

DATED : August 13, 1985

INVENTOR(S) : David W. Bley

It is certified that error appears in the above-identified patent and that said Letters Patent is hereby corrected as shown below:

In the drawings, Sheet 1, Fig. 1b, the reference numeral 37 should be added referencing the ground plane provided by the surface of connector board 9.

Signed and Sealed this

*Twenty-fifth* Day of *February 1986*

[SEAL]

*Attest:*

DONALD J. QUIGG

*Attesting Officer*

*Commissioner of Patents and Trademarks*